US008378198B2

(12) United States Patent
Cho

(10) Patent No.: US 8,378,198 B2
(45) Date of Patent: Feb. 19, 2013

(54) METHOD AND APPARATUS FOR DETECTING PITCH PERIOD OF INPUT SIGNAL

(75) Inventor: Jae-youn Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 146 days.

(21) Appl. No.: 12/832,606

(22) Filed: Jul. 8, 2010

(65) Prior Publication Data

US 2011/0167989 A1 Jul. 14, 2011

(30) Foreign Application Priority Data

Jan. 8, 2010 (KR) ..... 10-2010-0001900

(51) Int. Cl.
*G10H 1/00* (2006.01)

(52) U.S. Cl. ..... 84/615

(58) Field of Classification Search ..... 84/615
See application file for complete search history.

(56) References Cited

U.S. PATENT DOCUMENTS

| | | | | |
|---|---|---|---|---|
| 5,630,012 | A * | 5/1997 | Nishiguchi et al. | 704/208 |
| 6,018,706 | A * | 1/2000 | Huang et al. | 704/207 |
| 7,155,386 | B2 * | 12/2006 | Gao | 704/216 |
| 7,752,038 | B2 * | 7/2010 | Laaksonen et al. | 704/207 |
| 2010/0305953 | A1 * | 12/2010 | Susan et al. | 704/500 |
| 2011/0202337 | A1 * | 8/2011 | Fuchs et al. | 704/231 |

FOREIGN PATENT DOCUMENTS

| | | | |
|---|---|---|---|
| JP | 05265490 | A * | 10/1993 |
| JP | 11305794 | A | 11/1999 |

* cited by examiner

*Primary Examiner* — Jianchun Qin
(74) *Attorney, Agent, or Firm* — Sughrue Mion, PLLC

(57) ABSTRACT

Provided are a method and apparatus for detecting a pitch period of an input signal, the method including: generating division frames by dividing the input signal by a unit of a first predetermined number of samples at a time domain; detecting a reference sample which has a peak value in each division frame; generating extraction frames by extracting a second predetermined number of samples on the basis of the reference sample of each division frame; and detecting the pitch period of the input signal based on a similarity among the extraction frames.

21 Claims, 6 Drawing Sheets

METHOD AND APPARATUS FOR DETECTING PITCH PERIOD OF INPUT SIGNAL

CROSS-REFERENCE TO RELATED PATENT APPLICATION

This application claims priority from Korean Patent Application No. 10-2010-0001900, filed on Jan. 8, 2010 in the Korean Intellectual Property Office, the disclosure of which is incorporated herein in its entirety by reference.

BACKGROUND

1. Field

Apparatuses and methods consistent with exemplary embodiments relate to a method of detecting a pitch period of an input signal and a device implementing the same.

2. Description of the Related Art

Pitch period detection technology refers to a method of detecting a basic frequency of pitch periodic signals of voice or music. Among various pitch period detection technologies, a pitch period detection technology using auto-correlation is widely known. According to this technology, an operation for determining similarity between an original signal and a sample-moved signal is performed by moving a sample one by one. As a result, a large number of operations is needed.

SUMMARY

Exemplary embodiments provide a method of detecting a pitch period of an input signal and a device implementing the same.

According to an aspect of an exemplary embodiment, there is provided a method of detecting a pitch period of an input signal, the method including: generating division frames by dividing the input signal by a unit of a first predetermined number of samples at a time domain; detecting a reference sample which has a peak value in each division frame; generating extraction frames by extracting a second predetermined number of samples on the basis of the reference sample of each division frame; and detecting the pitch period of the input signal based on a similarity among the extraction frames.

The generating the division frames may include: detecting a kind of the input signal and a sampling frequency of the input signal; estimating a frequency range which corresponds to the input signal based on the detected kind of the input signal; and generating the division frames based on the estimated frequency range and the sampling frequency of the input signal.

The generating the division frames based on the estimated frequency range and the sampling frequency of the input signal may generate the division frames by dividing the input signal by a unit of samples, wherein the number of the samples may be less than or equal to a value obtained by dividing the sampling frequency of the input signal by a highest estimated frequency which is a highest frequency in the estimated frequency range.

The detecting the pitch period of the input signal may include: configuring an input buffer having a size capable of storing a third number of samples, the third number being greater than or equal to twice a number obtained by dividing the sampling frequency of the input signal by a lowest estimation frequency, wherein the lowest estimation frequency is a lowest frequency in the estimated frequency range; inputting a number of the generated extraction frames to the configured input buffer, wherein the number of the generated extraction frames inputted to the input buffer is a maximum capacity of the input buffer; and detecting the pitch period of the input signal based on a similarity among the input extraction frames.

The detecting the pitch period of the input signal based on the similarity among the input extraction frames may include: eliminating one of the input extraction frames from the input buffer in the case where the pitch period of the input signal cannot be detected using the input extraction frames; and inputting a non-input frame, which is an extraction frame not inputted to the buffer, to the buffer, wherein the eliminating and the inputting the non-input frame to the buffer is repeatedly performed until the pitch period of the input signal is detected.

The method may further include detecting a noise frame in which a proportion of samples which are estimated as a noise signal is greater than or equal to a predetermined value when the input signal includes an audio signal and the noise signal, wherein the detecting the pitch period of the input signal is performed on division frames except excluding the noise frames.

The detecting the pitch period of the input signal may include: detecting a first candidate frame and a second candidate frame whose cross-correlation is greater than or equal to a predetermined value from the extraction frames; detecting a pitch period estimation distance which indicates a number of samples corresponding to a distance from a starting point of the first candidate frame to a starting point of the second candidate frame; and detecting the detected pitch period estimation distance as the pitch period of the input signal.

The detecting the pitch period of the input signal may include: detecting a first candidate frame and a second candidate frame whose cross-correlation is greater than or equal to a predetermined value from the extraction frames; detecting a pitch period estimation distance which indicates a number of samples corresponding to a distance from a starting point of the first candidate frame to a starting point of the second candidate frame; detecting a third candidate frame whose starting point is distanced from the starting point of the second candidate frame by the pitch period estimation distance; and detecting the pitch period estimation distance as the pitch period of the input signal in the case where a cross-correlation value between the first and the third candidate frames or a cross-correlation value between the second and the third candidate frames is greater than or equal to the predetermined value.

The detecting of the reference sample may detect a sample having a greatest energy as the reference sample, among samples each of which is greater than a corresponding forward neighboring sample and a corresponding backward neighboring sample in energy in each division frame.

According to an aspect of another exemplary embodiment, there is provided an input signal pitch period detection device, including: a receiving unit which receives an input signal; a division frame generation unit which generates division frames by dividing the received input signal by a unit of a first predetermined number of samples at a time domain; a reference sample detection unit which detects a reference sample which has a peak value in each division frame; an extraction frame generation unit which generates extraction frames by extracting a second predetermined number of samples on the basis of the reference sample of each division frame; and a pitch period detection unit which detects the pitch period of the received input signal based on a similarity among the extraction frames.

According to an aspect of another exemplary embodiment, there is provided a computer-readable recording medium configured to store a program for performing the method of detecting a pitch period of an input signal, the method including: generating division frames by dividing the input signal by a unit of a first predetermined number of samples at a time domain; detecting a reference sample which has a peak value in each division frame; generating extraction frames by extracting a second predetermined number of samples on the basis of the reference sample of each division frame; and detecting the pitch period of the input signal based on a similarity among the extraction frames.

According to an aspect of another exemplary embodiment, there is provided a method of detecting a pitch period of an input signal including a first number of samples, the method including: detecting a second number of reference samples of the input signal, from among the first number of samples of the input signal, the second number being less than the first number; and detecting the pitch period of the input signal based on the second number of reference samples.

BRIEF DESCRIPTION OF THE DRAWINGS

The above and other features and advantages will become more apparent by describing in detail exemplary embodiments thereof with reference to the attached drawings in which.

DETAILED DESCRIPTION OF EXEMPLARY EMBODIMENTS

Figure 1:
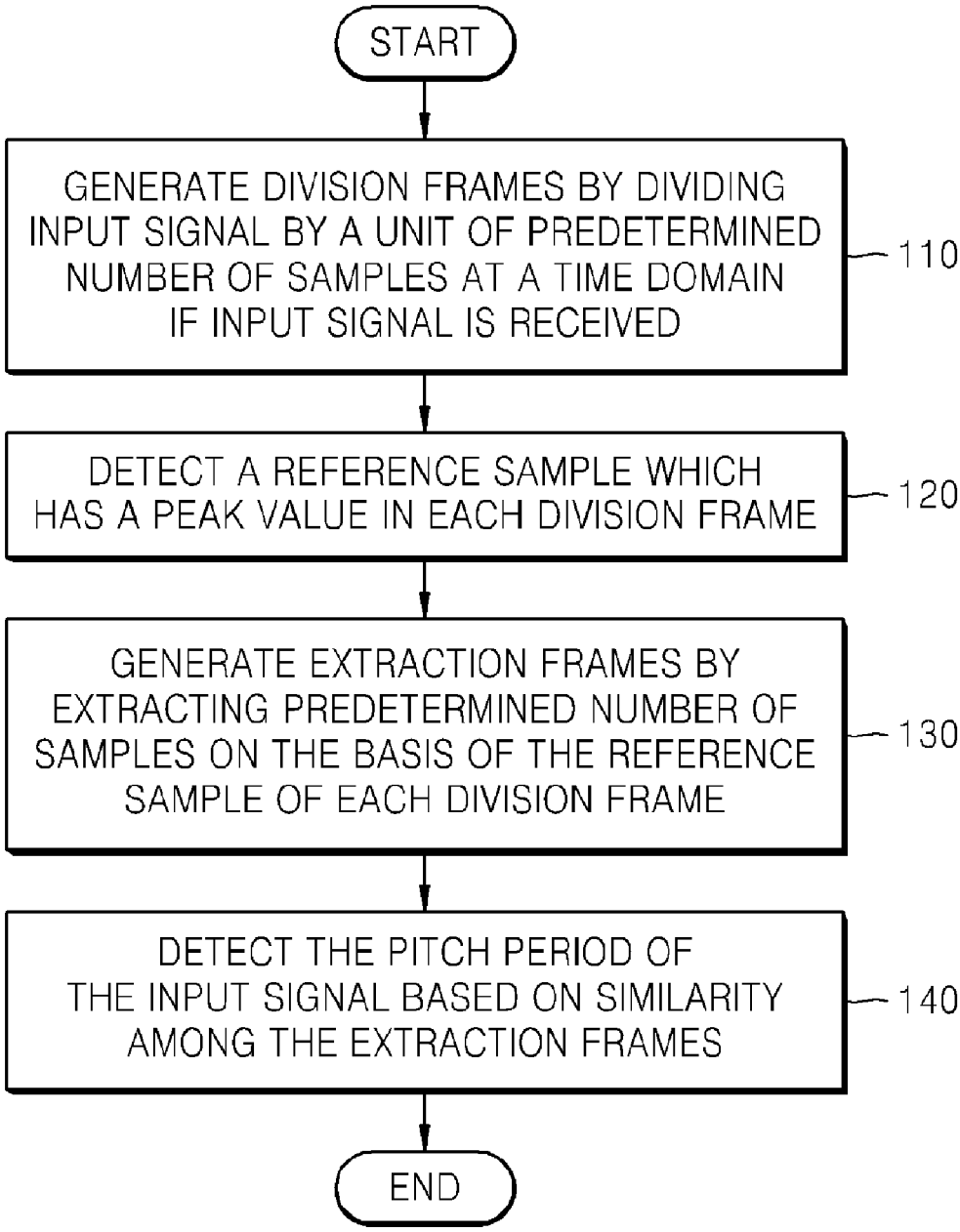
FIG. 1 is a flowchart for explaining a method of detecting a pitch period of an input signal according to an exemplary embodiment.

Exemplary embodiments will now be described more fully with reference to the accompanying drawings, in which like reference numerals refer to like elements throughout.

FIG. 1 is a flowchart for explaining a method of detecting a pitch period of an input signal according to an exemplary embodiment. Referring to FIG. 1, in operation 110, if the input signal is received, the input signal is divided with a predetermined number of samples as a dividing unit at a time domain so that division frames are generated. In the present exemplary embodiment, it is assumed that the input signal is a digital signal. For example, when the digital input signal includes 5000 samples, 100 division frames may be generated by dividing the input signal by a unit of 50 samples. Accordingly, each division frame has 50 samples. At this time, the number of samples to be included in each division frame is determined according to a predetermined basis. Meanwhile, the input signal may be an audio signal of music or an audio signal of a human voice such as a lecture or a speech, though it is understood that another exemplary embodiment is not limited thereto. A detailed description of operation 110 will be given later with reference to FIG. 3.

In operation 120, a reference sample which has a peak value is detected in each frame. For example, a sample having a greatest energy may be determined as the reference sample from among the samples included in each division frame, and among samples each of which is greater than its forward neighboring sample and backward neighboring sample in energy.

Figure 2:
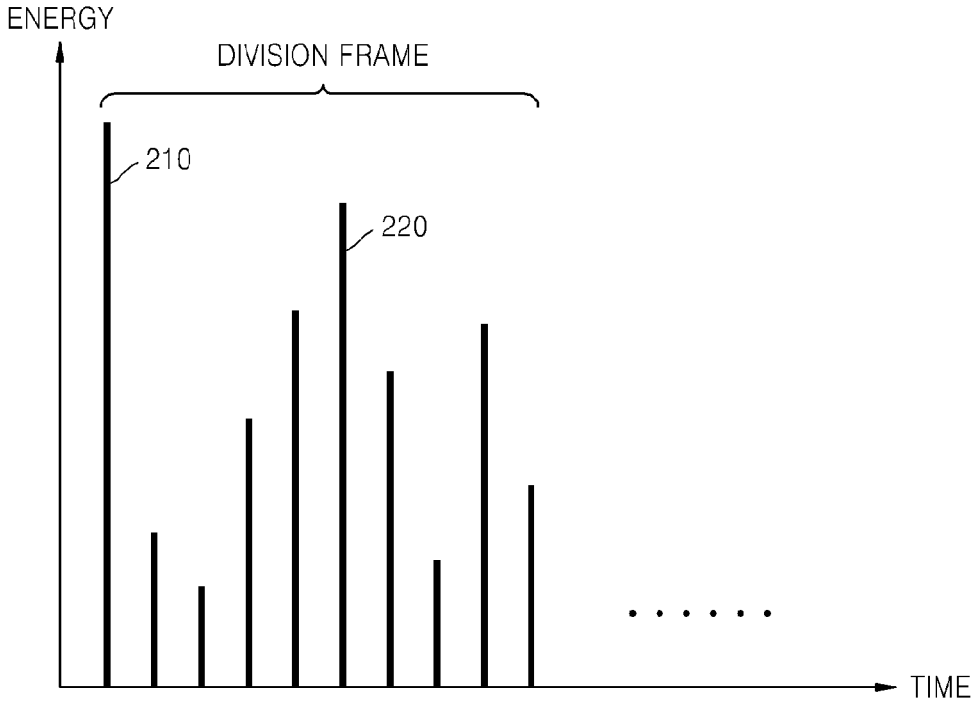
FIG. 2 is a diagram for explaining a method of detecting a reference sample according to an exemplary embodiment.

FIG. 2 is a diagram for explaining a method of detecting a reference sample according to an exemplary embodiment. Referring to FIG. 2, a division frame including 10 samples is illustrated. Among these samples, although a first sample 210 has the greatest energy, there is only a backward neighboring sample, i.e., a second sample, of the first sample 210. That is, a forward neighboring sample of the first sample 210 does not exist. Therefore, since the first sample 210 does not satisfy the condition of being greater than a forward neighboring sample in energy, the first sample 210 is not detected as the peak value.

However, although a fifth sample 220 has lower energy than the first sample 210, the fifth sample 220 has the greatest energy except for the first sample 210, and the energy of the fifth sample 220 is greater than that of a forward neighboring sample, i.e., a fourth sample, and that of a backward neighboring sample, i.e., a sixth sample. Accordingly, the fifth sample 220 is detected as the peak value.

Meanwhile, although the reference sample is detected in the division frame illustrated in FIG. 2, there may be a division frame where the reference sample is not detected. For example, in a case where energies of samples included in a division frame are continuously decreased, the reference sample is not detected in that division frame.

In another exemplary embodiment, when the input signal includes the audio signal and a noise signal, noise frames where the proportion of samples which are estimated as the noise signal is greater than or equal to a critical value may be detected. In such a case, the reference sample detecting operation may be performed for only division frames other than the noise frames. As a result, unnecessary operations are reduced by not detecting the reference samples in the noise frames because the noise frames do not affect the detection of the pitch period of the input signal.

Referring back to FIG. 1, in operation 130, extraction frames are generated by extracting a predetermined number of samples from each division frame on the basis of the reference sample. At this time, the number of the samples extracted on the basis of the reference sample may be equal to or different from the number of samples included in the division frame.

For example, if it is assumed that the division frames have been generated by dividing the input signal by a unit of 50 samples, the extraction frames may be generated by extracting 50 samples on the basis of each reference sample of the division frames, or by extracting 30 samples on the basis of each reference sample of the division frames. In the case of the former, the extraction frame includes 50 samples, and in the case of the latter, the extraction frame includes 30 samples.

In operation 140, based on similarity among extraction frames, the pitch period of the input signal is detected. In an exemplary embodiment, the input signal pitch period is detected according to whether there exists extraction frames whose cross-correlation is greater than or equal to a critical value. A detailed description of operation 140 will be given later with reference to FIGS. 4 and 5.

Figure 3:
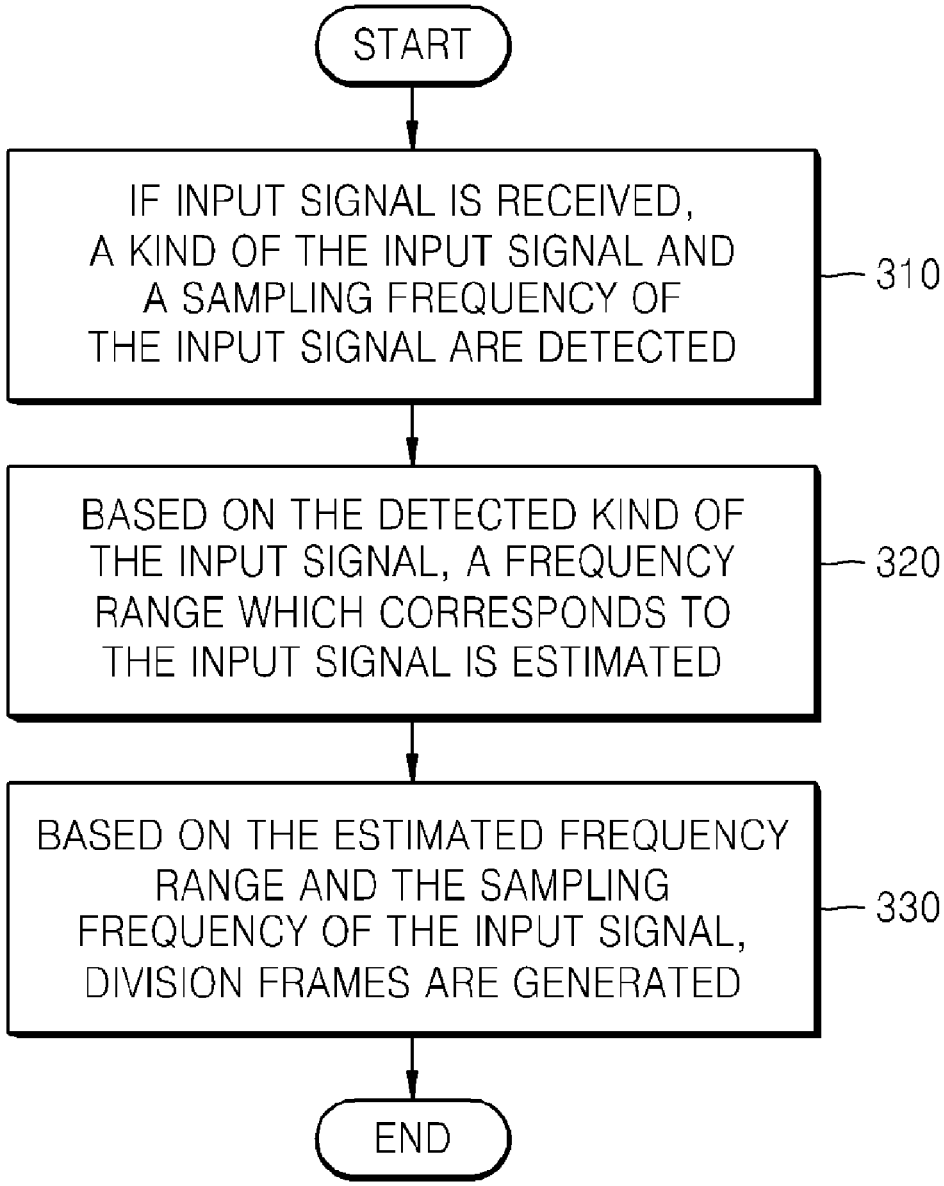
FIG. 3 is a flowchart for explaining a method of generating division frames according to an exemplary embodiment.

FIG. 3 is a flowchart for explaining a method of generating division frames according to an exemplary embodiment. Referring to FIG. 3, in operation 310, if the input signal is received, a kind of the input signal and a sampling frequency of the input signal are detected. At this time, the sampling frequency refers to a frequency which has been used for sampling the digital signal, i.e., the input signal. As the sampling frequency increases, the quality of sound becomes better.

In operation 320, based on the detected kind of the input signal, a frequency range which corresponds to the input signal is estimated. For example, if the input signal is the audio signal of a human voice, the input signal has a frequency ranging from 60 Hz to 300 Hz.

In operation 330, based on the estimated frequency range and the sampling frequency of the input signal, the division frames are generated. In detail, the division frames may be generated by dividing the input signal by a unit of samples, wherein the number of samples is less than or equal to a value obtained by dividing the sampling frequency of the input signal by a highest estimated frequency, which is the highest frequency in the estimated frequency range.

For example, if the input signal is the voice signal, the highest estimated frequency is 300 Hz, and if the sampling frequency is 44.1 kHz, the division frames are generated by dividing the input signal by a unit of 147, which is less than 44100/300, or fewer samples. That is, the number of samples included in each division frame is less than or equal to 147.

The number of samples included in each division frame may be determined in this manner in order to include only a corresponding number of samples at most in one division frame, wherein the corresponding number corresponds to one of the audio signal pitch period. If the number of the samples included in the division frame is larger than the above-mentioned basis, samples may be included in one division frame, wherein the number of these samples corresponds to double the audio signal pitch period.

Figure 4:
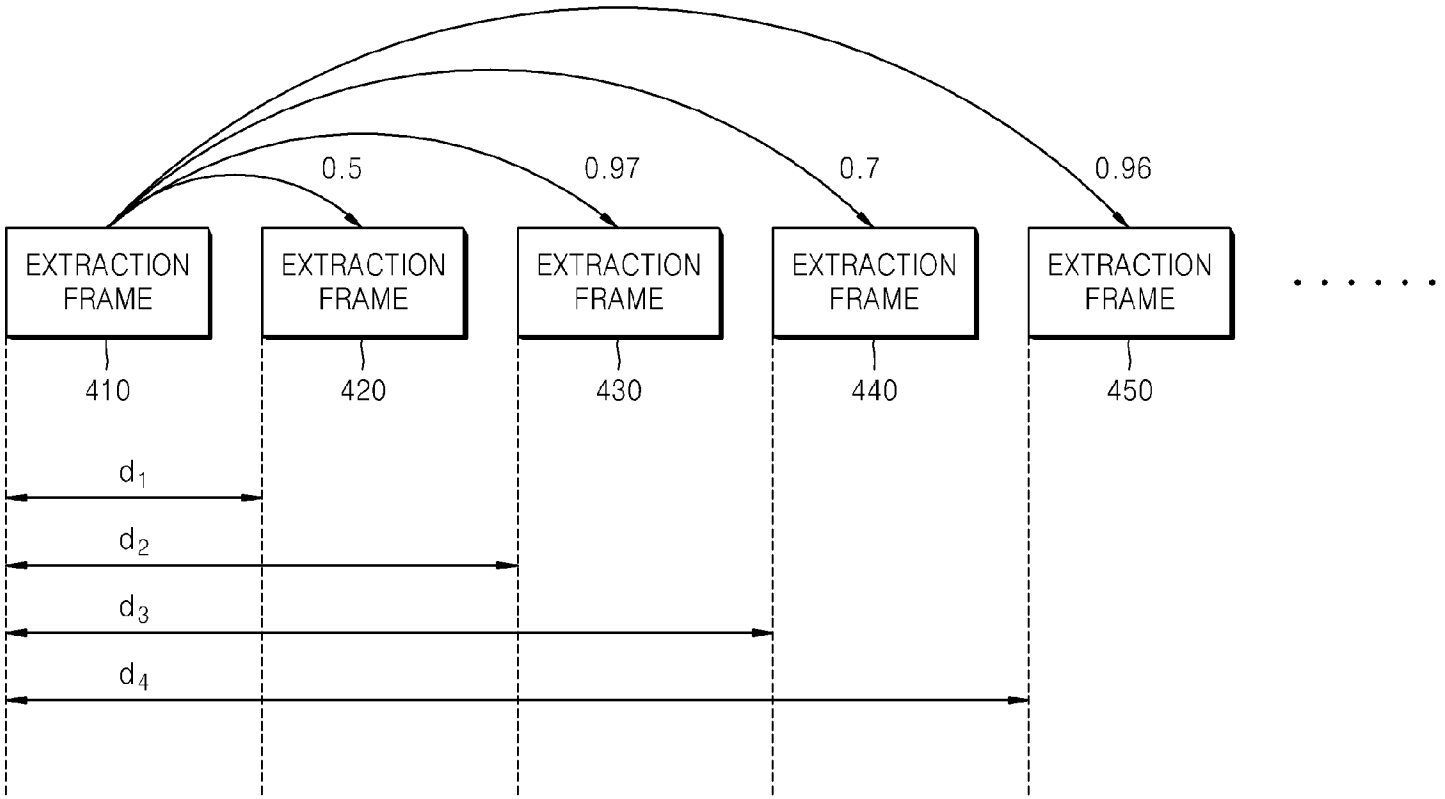
FIG. 4 is a diagram for explaining a method of detecting a pitch period of an input signal based on similarity among extraction frames according to an exemplary embodiment.

FIG. 4 is a diagram for explaining a method of detecting a pitch period of an input signal based on a similarity among extraction frames according to an exemplary embodiment. Referring to FIG. 4, first to fifth extraction frames 410 to 450 are illustrated. Over the first to fifth extraction frames 410 to 450, cross-correlation values between the first extraction frame 410 and the second to the fifth extraction frames 420 to 450 are respectively illustrated. Under the five extraction frames 410 to 450, distances in a time domain from the first extraction frame 410 to the second to the fifth extraction frames 420 to 450 are respectively illustrated. Herein, the cross-correlation values between the first extraction frame 410 and the second to the fifth extraction frames 420 to 450 refer to cross-correlation values between the samples included in the first extraction frame 410 and those of the second to the fifth extraction frames 420 to 450. Also, each of the first to the fifth extraction frames 410 to 450 has a same number of samples. Meanwhile, although not illustrated in FIG. 4, cross-correlation values between the first extraction frame 410 and extraction frames after the fifth extraction frame 450 may also be calculated.

In the exemplary embodiment of FIG. 4, it is assumed that a critical value of the cross-correlation value is given as 0.95, though it is understood that another exemplary embodiment is not limited thereto. If the cross-correlation value between two extraction frames is greater than or equal to 0.95, it is determined that the two extraction frames are similar to each other.

In FIG. 4, the cross-correlation values between the first extraction frame 410 and the second to the fifth extraction frames 420 to 450 are respectively 0.5, 0.97, 0.7 and 0.96. Based on the cross-correlation values illustrated in FIG. 4, it is determined that the first extraction frame 410 is similar to the third extraction frame 430 and to the fifth extraction frame 450.

Based on this result, two exemplary methods of detecting the pitch period of the input signal are described as follows. According to a first exemplary method, based on the cross-correlation value between two extraction frames, the pitch period of the input signal is detected. In this exemplary method, since the cross-correlation value between the first and the third extraction frames 410 and 430 is 0.97 which is greater than the critical value, the first extraction frame 410 is detected as a first candidate frame and the third extraction frame 430 is detected as a second candidate frame. Then, a pitch period estimation distance d2, which is a distance from a starting point of the first candidate frame 410 to a starting point of the second candidate frame 430, is detected. In the first exemplary method, the pitch period estimation distance d2 detected in this manner is directly determined as the pitch period of the input signal. Herein, in the first exemplary method, if the pitch period of the input signal is determined in this manner, the cross-correlation values between the first extraction frame 410 and the extraction frames after the third extraction frame are not calculated.

According to a second exemplary method, based on the cross-correlation values among three extraction frames, the pitch period of the input signal is detected. Furthermore, according to the second exemplary method, after the first extraction frame 410 is detected as the first candidate frame and the third extraction frame 430 is detected as the second candidate frame, the pitch period estimation distance d2, which is the distance from the starting point of the first candidate frame 410 to the starting point of the second candidate frame 430, is detected in the same manner as the first method. However, in the second exemplary method, this detected pitch period estimation distance d2 is not directly determined as the pitch period of the input signal. That is, a process is further performed for verifying whether the pitch period estimation distance d2 corresponds to the pitch period of the input signal.

To this end, in the second exemplary method, the fifth extraction frame 450, whose starting point is distanced from that of the second candidate frame 430 by the pitch period estimation distance d2, is detected as a third candidate frame. Herein, a distance d4 from the starting point of the first candidate frame 410 to that of the third candidate frame 450 is double the pitch period estimation distance d2.

If the third candidate frame 450 is detected, it is determined whether the cross-correlation value between the first and the third candidate frames 410 and 450 or the cross-correlation value between the second and the third candidate frames 430 and 450 is greater than or equal to the critical value in order to verify whether the pitch period estimation distance d2 corresponds to the pitch period of the input signal.

The cross-correlation value between the first and the third candidate frames 410 and 450 or the cross-correlation value between the second and the third candidate frames 430 and 450 is used for the verification because the samples included in two extraction frames distanced by the pitch period estimation distance d2 or twice the pitch period estimation distance d2 have similar patterns if the pitch period estimation distance d2 is the pitch period of the input signal.

According to a result of the determination, if the cross-correlation value between the first and the third candidate frames 410 and 450 or the cross-correlation value between the second and the third candidate frames 430 and 450 is greater than or equal to the critical value, it is determined that the pitch period estimation distance d2 is the pitch period of the input signal.

However, if the cross-correlation value between the first and the third candidate frames 410 and 450 is less than the critical value or the cross-correlation value between the second and the third candidate frames 430 and 450 is less than the critical value, it is determined that the pitch period estimation distance d2 is not the pitch period of the input signal. As a result of this determination, the cross-correlation values between the first extraction frame 410 and the second to the fifth extraction frames 420 to 450 are no longer calculated in the exemplary method. Rather, based on the cross-correlation values between the second extraction frame 420 and the third to the fifth extraction frames 430 to 450, the pitch period of the input signal is determined.

In FIG. 4, since the cross-correlation value between the first and the third candidate frames 410 and 450 is 0.96, which is greater than the critical value, the pitch period estimation distance d2 becomes the pitch period of the input signal.

Therefore, an exemplary embodiment is capable of detecting the pitch period of the input signal by calculating the cross-correlation values among the extraction frames. Accordingly, in comparison with a related art technology where the pitch period of the input signal is calculated by moving a sample one by one by using the auto-correlation, the pitch period of the input signal can be detected through fewer operations in the exemplary embodiment.

Meanwhile, in another exemplary embodiment, an input buffer may be configured, and based on a similarity among extraction frames inputted to the input buffer, the pitch period of the input signal may be detected. This is explained with reference to FIG. 5 as follows.

Figure 5:
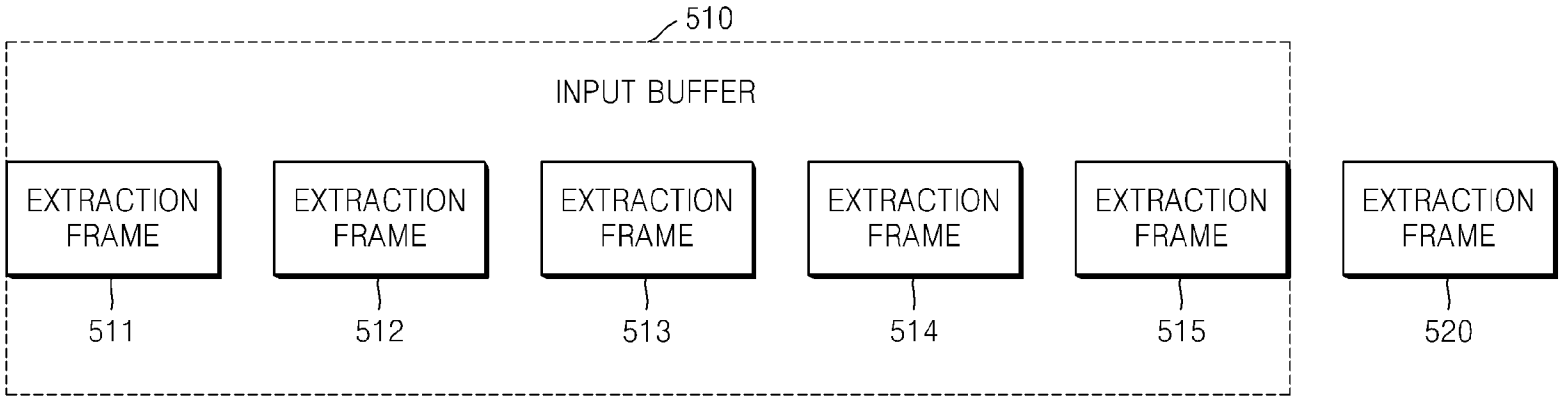
FIG. 5 is a diagram for explaining a method of detecting a pitch period of an input signal using an input buffer according to an exemplary embodiment.

FIG. 5 is a diagram for explaining a method of detecting a pitch period of an input signal using an input buffer according to an exemplary embodiment. Referring to FIG. 5, first to fifth input frames 511 to 515, which are extraction frames 511 to 515 inputted to an input buffer 510, and a non-input frame 520, which is an extraction frame 520 not inputted to the input buffer 510, are illustrated.

In the input buffer 510 of FIG. 5, the first to fifth input frames 511 to 515 are inputted. Here, a maximum number of frames that the input buffer 510 is capable of storing is 5, though it is understood that another exemplary embodiment is not limited thereto. The pitch period of the input signal is detected based on a similarity among these first to fifth input frames 511 to 515 inputted to the input buffer 510.

However, in the case where the pitch period of the input signal cannot be detected using the first to fifth input frames 511 to 515 inputted to the input buffer 510, one of the first to fifth input frames 511 to 515 may be eliminated from the input buffer 510, such that the non-input frame 520 may be inputted to the input buffer 510.

For example, when there is no cross-correlation value which is greater than or equal to the critical value among the cross-correlation values between the first input frame 511 and the second to the fifth input frames 512 to 515, the first input frame 511 may be eliminated from the input buffer 510, and the non-input frame 520 may be inputted to the input buffer 510.

This operation of eliminating one of the first to fifth input frames 511 to 515 from the input buffer 510 and inputting the non-input frame 520 to the input buffer 510 may be repeatedly performed until the pitch period of the input signal is detected using input frames 511 to 515 or 520 inputted to the input buffer.

Herein, a size of the input buffer 510 may be determined for storing a number of samples that is greater than or equal to twice a number obtained by dividing the sampling frequency of the input signal by a lowest estimation frequency. Herein, the lowest estimation frequency is the lowest frequency in the frequency range estimated based on the kind of the input signal. For example, in the case where the input signal is the voice signal, since the frequency range is between 60 Hz and 300 Hz, the lowest estimation frequency is 60 Hz. If the sampling frequency is 44.1 kHz, the input buffer 510 has a size larger than 2*(44100/60). That is, the input buffer 510 includes 1470 or more samples. If it is assumed that the extraction frame includes 147 samples, one input buffer is capable of storing 10 extraction frames.

However, it is understood that all exemplary embodiments are not limited thereto. For example, in another exemplary embodiment, the size of the input buffer 510 may be determined based on the number of extraction frames to be stored in the input buffer 510. For instance, the size of the input buffer 510 may be determined as a size capable of storing 10 or 5 extraction frames.

Figure 6:
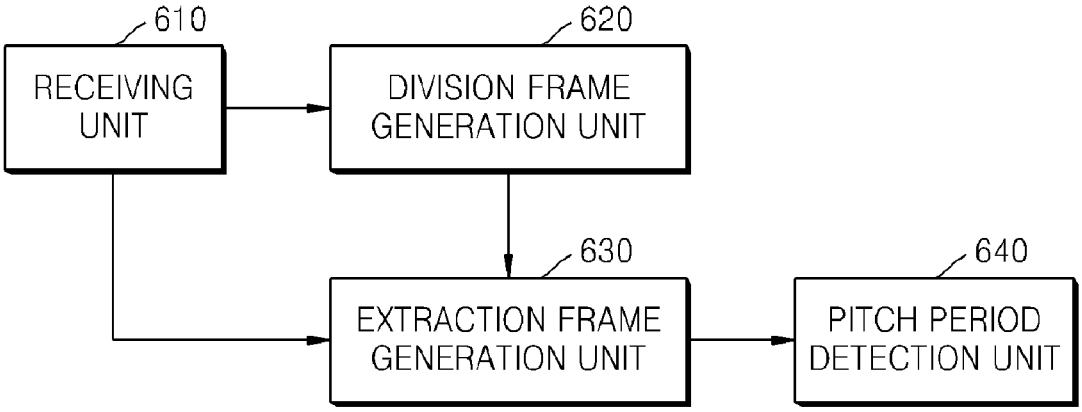
FIG. 6 is a diagram for explaining a device for detecting a pitch period of an input signal according to an exemplary embodiment.

FIG. 6 is a diagram for explaining a device for detecting a pitch period of an input signal according to an exemplary embodiment. Referring to FIG. 6, a receiving unit 610 receives the input signal. Furthermore, a reference sample detection unit 620 detects a reference sample which has a peak value in each division frame. When the input signal includes the audio signal and the noise signal, the reference sample detection unit 620 may not perform the reference sample detection operation for the noise frames where the proportion of samples which are estimated as the noise signal is greater than or equal to the critical value. The input signal pitch period detection device according to an exemplary embodiment may further include a noise frame detection unit (not shown) which detects the noise frames.

An extraction frame generation unit 630 generates the extraction frames by extracting a predetermined number of samples on the basis of the reference sample of each division frame. A pitch period detection unit 640 detects the pitch period of the input signal based on a similarity among the extraction frames.

While not restricted thereto, exemplary embodiments may be written as one or more programs to be performed by a computer. By using a computer-readable recording medium, exemplary embodiments may be realized at a general-purpose or special-purpose digital computer which operates the program. Furthermore, the computer-readable recording medium includes a magnetic storage medium (e.g., ROM, floppy disk, hard disk and the like) and an optical reading medium (e.g., CD-ROM, DVD and the like). Also, exemplary embodiments may be written as computer programs transmitted over a computer-readable transmission medium, such as a carrier wave, and received and implemented in general-purpose or special-purpose digital computers that execute the programs. Moreover, while not required in all aspects, one or more units of the input signal pitch period detection device can include a processor or microprocessor executing a computer program stored in a computer-readable medium.

While exemplary embodiments have been particularly shown and described with reference to the accompanying drawings, it will be understood by those of ordinary skill in the art that various changes in form and details may be made therein without departing from the spirit and scope of the present invention as defined by the following claims.

What is claimed is:

1. A method of detecting a pitch period of an input signal, the method comprising:

generating division frames by dividing the input signal by a unit of a first predetermined number of samples at a time domain;

detecting a reference sample which has a peak value in each division frame; generating extraction frames by extracting a second predetermined number of samples from each division frame on the basis of the reference sample; and detecting the pitch period of the input signal based on a similarity among the extraction frames, wherein the detecting the reference sample comprises detecting a sample having a greatest energy as the reference sample, among samples each of which has a greater energy than a corresponding forward neighboring sample and a corresponding backward neighboring sample in each division frame.

2. The method of claim 1, wherein the generating the division frames comprises:

detecting a kind of the input signal and a sampling frequency of the input signal;

estimating a frequency range which corresponds to the input signal based on the detected kind of the input signal; and generating the division frames based on the estimated frequency range and the sampling frequency of the input signal.

3. The method of claim 2, wherein the first predetermined number is less than or equal to a value obtained by dividing the sampling frequency of the input signal by a highest estimated frequency which is a highest frequency in the estimated frequency range.

4. The method of claim 3, wherein the detecting the pitch period of the input signal comprises:

configuring an input buffer having a size capable of storing a third number of samples, the third number being greater than or equal to twice a number obtained by dividing the sampling frequency of the input signal by a lowest estimation frequency, wherein the lowest estimation frequency is a lowest frequency in the estimated frequency range;

inputting a number of the generated extraction frames to the configured input buffer, wherein the number of the generated extraction frames inputted to the input buffer is a maximum capacity of the input buffer; and detecting the pitch period of the input signal based on a similarity among the input extraction frames.

5. The method of claim 4, wherein the detecting the pitch period of the input signal based on the similarity among the input extraction frames comprises:

eliminating one of the input extraction frames from the input buffer in response to the pitch period of the input signal being incapable of being detected using the input extraction frames; and inputting a non-input extraction frame, which is an extraction frame not inputted to the buffer, to the buffer, wherein the eliminating and the inputting the non-input frame to the buffer are repeatedly performed until the pitch period of the input signal is detected.

6. The method of claim 1, further comprising:

detecting a noise frame in which a proportion of samples which are estimated as a noise signal is greater than or equal to a predetermined value when the input signal comprises an audio signal and the noise signal, wherein the detecting the pitch period of the input signal comprises detecting the pitch period of the input signal based on a similarity among extraction frames other than the noise frame.

7. The method of claim 1, wherein the detecting the pitch period of the input signal comprises:

detecting a first candidate frame and a second candidate frame having a cross-correlation greater than or equal to a predetermined value from the extraction frames;

detecting a pitch period estimation distance which indicates a number of samples corresponding to a distance from a starting point of the first candidate frame to a starting point of the second candidate frame; and detecting the detected pitch period estimation distance as the pitch period of the input signal.

8. The method of claim 1, wherein the detecting the pitch period of the input signal comprises:

detecting a first candidate frame and a second candidate frame having a cross-correlation greater than or equal to a predetermined value from the extraction frames;

detecting a pitch period estimation distance which indicates a number of samples corresponding to a distance from a starting point of the first candidate frame to a starting point of the second candidate frame;

detecting a third candidate frame whose starting point is distanced from the starting point of the second candidate frame by the pitch period estimation distance; and detecting the pitch period estimation distance as the pitch period of the input signal in response to a cross-correlation value between the first and the third candidate frames or a cross-correlation value between the second and the third candidate frames being greater than or equal to the predetermined value.

9. The method of claim 1, wherein the first predetermined number is equal to the second predetermined number.

10. The method of claim 1, wherein the first predetermined number is less than a total number of samples of the input signal.

11. A non-transitory computer-readable recording medium having recorded thereon a program for performing the method of claim 1.

12. An input signal pitch period detection device, comprising:

a receiving unit which receives an input signal;

a division frame generation unit which generates division frames by dividing the received input signal by a unit of a first predetermined number of samples at a time domain;

a reference sample detection unit which detects a reference sample which has a peak value in each division frame;

an extraction frame generation unit which generates extraction frames by extracting a second predetermined number of samples from each division frame on the basis of the reference sample; and a pitch period detection unit which detects the pitch period of the input signal based on similarity among the extraction frames, wherein the reference sample detection unit detects a sample having a greatest energy as the reference sample, among samples each of which has a greater energy than a corresponding forward neighboring sample and a corresponding backward neighboring sample in each division frame.

13. The input signal pitch period detection device of claim 12, wherein the division frame generation unit detects a kind of the received input signal and a sampling frequency of the received input signal, and estimates a frequency range which corresponds to the received input signal based on the detected kind of the received input signal, and generates the division frames based on the estimated frequency range and the sampling frequency of the input signal.

14. The input signal pitch period detection device of claim 13, wherein the first predetermined number is less than or equal to a value obtained by dividing the sampling frequency of the input signal by a highest estimated frequency which is a highest frequency in the estimated frequency range.

15. The input signal pitch period detection device of claim 14, wherein the pitch period detection unit:

configures an input buffer having a size capable of storing a third number of samples, the third number being greater than or equal to a number obtained by dividing the sampling frequency of the input signal by a lowest estimation frequency, wherein the lowest estimation frequency is a lowest frequency in the estimated frequency range;

inputs the generated extraction frames to the configured input buffer, wherein the number of the generated extraction frames inputted to the input buffer is a maximum capacity of the input buffer; and detects the pitch period of the input signal based on a similarity among the input extraction frames.

16. The input signal pitch period detection device of claim 15, wherein:

the pitch period detection unit eliminates one of the input extraction frames from the input buffer in response to the pitch period of the input signal being incapable of being detected using the input extraction frames, and inputs a non-input extraction frame, which is an extraction frame not inputted to the buffer, to the buffer; and the pitch period detection unit repeatedly performs the eliminating and the inputting of one of the non-input frames to the buffer until the pitch period of the input signal is detected.

17. The input signal pitch period detection device of claim 12, further comprising:

a noise frame detection unit which detects a noise frame in which a proportion of samples which are estimated as a noise signal is greater than or equal to a predetermined value when the input signal comprises an audio signal and the noise signal, wherein the reference sample detection unit detects the pitch period of the input signal based on a similarity among extraction frames other than the noise frame.

18. The input signal pitch period detection device of claim 12, wherein the pitch period detection unit:

detects a first candidate frame and a second candidate frame having a cross-correlation greater than or equal to a predetermined value from the extraction frames;

detects a pitch period estimation distance which indicates a number of samples corresponding to a distance from a starting point of the first candidate frame to a starting point of the second candidate frame; and detects the detected pitch period estimation distance as the pitch period of the input signal.

19. The input signal pitch period detection device of claim 12, wherein the pitch period detection unit:

detects a first candidate frame and a second candidate frame having a cross-correlation greater than or equal to a predetermined value from the extraction frames;

detects a pitch period estimation distance which indicates a number of samples corresponding to a distance from a starting point of the first candidate frame to a starting point of the second candidate frame;

detects a third candidate frame whose starting point is distanced from the starting point of the second candidate frame by the pitch period estimation distance; and detects the pitch period estimation distance as the pitch period of the input signal in response to a cross-correlation value between the first and the third candidate frames or a cross-correlation value between the second and the third candidate frames being greater than or equal to the predetermined value.

20. A method of detecting a pitch period of an input signal including a first number of samples, the method comprising:

dividing the input signal into a plurality of division frames;

detecting a second number of reference samples of the input signal, from among the first number of samples of the input signal, the second number being less than the first number; and detecting the pitch period of the input signal based on a cross-correlation among the second number of reference samples, wherein the reference sample is a sample having a greatest energy, among samples each of which has a greater energy than a corresponding forward neighboring sample and a corresponding backward neighboring sample in each of the plurality division frames.

21. A non-transitory computer-readable recording medium having recorded thereon a program for performing the method of claim 20.

* * * * *